US008396390B2

(12) United States Patent
Tanaka

(10) Patent No.: US 8,396,390 B2
(45) Date of Patent: Mar. 12, 2013

(54) INTERMEDIATE TRANSFER BODY AND IMAGE FORMING APPARATUS

(75) Inventor: Tomomi Tanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 350 days.

(21) Appl. No.: 12/836,765

(22) Filed: Jul. 15, 2010

(65) Prior Publication Data

US 2011/0033199 A1 Feb. 10, 2011

(30) Foreign Application Priority Data

Aug. 5, 2009 (JP) ..... 2009-182902

(51) Int. Cl.
*G03G 15/16* (2006.01)

(52) U.S. Cl. ..... 399/101; 399/154; 399/297

(58) Field of Classification Search ..... 399/101, 399/154, 297
See application file for complete search history.

(56) References Cited

U.S. PATENT DOCUMENTS

| | | | | |
|---|---|---|---|---|
| 6,422,696 | B1 * | 7/2002 | Takahashi et al. | 347/103 |
| 2006/0099016 | A1 * | 5/2006 | Watanabe et al. | 399/351 |
| 2009/0003871 | A1 | 1/2009 | Matsumoto | |
| 2009/0080949 | A1 * | 3/2009 | Yamanobe et al. | 399/308 |

FOREIGN PATENT DOCUMENTS

| | | | |
|---|---|---|---|
| JP | 09-325621 | A | 12/1997 |
| JP | 11-095567 | A | 4/1999 |
| JP | 2004-272118 | A | 9/2004 |
| JP | 2009-008904 | A | 1/2009 |

* cited by examiner

*Primary Examiner* — Walter L Lindsay, Jr.
*Assistant Examiner* — Roy Y Yi
(74) *Attorney, Agent, or Firm* — Renner, Otto, Boisselle & Sklar, LLP

(57) ABSTRACT

An intermediate transfer body is provided. An intermediate transfer body includes an intermediate transfer belt and a belt cleaning section including a cleaning blade. A plurality of projecting portions extending in parallel with a rotation direction of the intermediate transfer belt are provided on a surface of an elastic layer of the intermediate transfer belt. The cleaning blade is formed such that a width W1 of one end in a lateral direction thereof is longer than a width W2 of the elastic layer in a width direction of the intermediate transfer belt.

5 Claims, 6 Drawing Sheets

INTERMEDIATE TRANSFER BODY AND IMAGE FORMING APPARATUS

CROSS-REFERENCE TO RELATED APPLICATION

This application claims priority to Japanese Patent Application No. 2009-182902, which was filed on Aug. 5, 2009, the contents of which are incorporated herein by reference in its entirety.

BACKGROUND OF THE INVENTION

1. Field of the Invention

The present invention relates to an intermediate transfer body and an image forming apparatus.

2. Description of the Related Art

In an electrophotographic image forming apparatus is employed a method in which a toner image is obtained by developing an electrostatic latent image on an electrostatic latent image bearing member with a toner and the toner image is transferred to a recording medium to form the toner image on the recording medium is used in an electrophotographic image forming apparatus. As a transfer method in an image forming apparatus is used a method in which a toner image formed on an electrostatic latent image bearing member is transferred to an intermediate transfer belt which bears and conveys a toner image transferred thereto, the toner image transferred to the intermediate transfer belt is electrostatically moved to a recording medium by a transfer section which faces the intermediate transfer belt with the recording medium interposed therebetween. A belt cleaning apparatus is arranged to remove a residual toner remaining on an outer peripheral surface of an intermediate transfer belt after transferring a toner image to a recording medium.

A blade type belt cleaning apparatus is widely used as a belt cleaning apparatus. The blade type belt cleaning apparatus is a belt cleaning apparatus in which a plate-like cleaning blade abuts on a surface which bears a toner image of an intermediate transfer belt and a residual toner remaining on an outer peripheral surface of the intermediate transfer belt is scraped off. In such a blade type belt cleaning apparatus, in the case where surface roughness of an outer peripheral surface of the intermediate transfer belt is large, an abutting portion of the cleaning blade catches on the outer peripheral surface of the intermediate transfer belt. As a result, the cleaning blade itself is damaged, and reversal phenomenon that the cleaning blade rides up due to rotation of the intermediate transfer belt occurs. Those problems decrease removal efficiency of the residual toner. The reversal phenomenon that the cleaning blade rides up markedly occurs at a portion corresponding to an end in a width direction of the intermediate transfer belt among abutting portions of the cleaning blade to the intermediate transfer belt.

To overcome those problems, Japanese Unexamined Patent Publication JP-A 11-95567 (1999) discloses an image forming apparatus in which a cleaning blade provided so as to be parallel to a width direction of an intermediate transfer belt abuts on an intermediate transfer belt having formed thereon difference in level extending in a width direction and having large surface roughness, and the intermediate transfer belt is rotated in a direction that friction coefficient to the abutting portion of the cleaning blade becomes smaller.

In recent years, an intermediate transfer belt comprising a base material made of polyimide, and an elastic layer formed on a surface of the base material is being used in an electrophotographic image forming apparatus in order to improve a toner image bearing ability of an intermediate transfer belt and transferability of a toner image to a recording medium.

In the case where the intermediate transfer belt having an elastic layer is applied to the image forming apparatus disclosed in JP-A 11-95567, the cleaning blade abuts on the elastic layer on an outer peripheral surface of the intermediate transfer belt.

The image forming apparatus disclosed in JP-A 11-95567 is constituted such that the intermediate transfer belt is rotated in a direction that friction coefficient to an abutting portion of the cleaning blade is decreased, Therefore, the cleaning blade abuts on the intermediate transfer belt such that a region having high difference in level and a region having low difference in level, formed on the outer peripheral surface of the intermediate transfer belt are repeated in this order, and removes a residual toner.

For this reason, when an abutting position of the cleaning blade to the outer peripheral surface of the intermediate transfer belt changes from the region having high difference in level to the region having low difference in level, the cleaning blade bounds on the outer peripheral surface of the intermediate transfer belt. As a result, not only the residual toner scraped off from the intermediate transfer belt may scatter, but the abutting portion of the cleaning blade may bite in the inside in a thickness direction from the outer peripheral surface of the intermediate transfer belt. The elastic layer on the outer peripheral surface of the intermediate transfer belt is a layer liable to undergo elastic deformation. Therefore, the abutting portion of the cleaning blade, particularly an end in a width direction of the cleaning blade, excessively bites in the inside in a thickness direction from the outer peripheral surface of the intermediate transfer belt. Thus, where the abutting portion of the cleaning blade bites in the outer peripheral surface of the intermediate transfer belt, reversal phenomenon of the cleaning blade occurs, and removal efficiency of a residual toner is decreased. Furthermore, in the case where the cleaning blade bounds on the outer peripheral surface of the intermediate transfer belt due to rotation of the intermediate transfer belt, the cleaning blade does not abut on a boundary portion between the region having high difference in level and the region having low difference in level on the outer peripheral surface of the intermediate transfer belt. As a result, a residual toner remaining on the boundary portion cannot be removed, and uniform cleaning performance to the outer peripheral surface of the intermediate transfer belt cannot be obtained.

SUMMARY OF THE INVENTION

An object of the invention is to provide an intermediate transfer body comprising an intermediate transfer belt having an elastic layer, and a belt cleaning section which removes a residual toner, the intermediate transfer body preventing a residual toner from scattering, and in addition to this, and being able to obtaining uniform cleaning performance to an outer peripheral surface of the intermediate transfer belt by the belt cleaning section and additionally preventing removal efficiency of a residual toner from decreasing.

The invention provides an intermediate transfer body comprising:

an endless intermediate transfer belt rotatably disposed by being supported around a plurality of supporting rollers with tension, the endless intermediate transfer belt bearing and transporting an toner image on an outer peripheral surface thereof, the endless intermediate transfer belt including:

a base material, an elastic layer formed on a surface of the base material, and a plurality of projecting portions formed side by side in a width direction of the intermediate transfer belt, each projecting outwardly from a surface of the elastic layer, extending over an entire periphery of the elastic layer in parallel with a rotation direction of the intermediate transfer belt, the plurality of projecting portions each having a minimum projection height of 2.0 μm or more, a maximum projection height of 6.0 μm or less, a minimum top face width of 2.0 μm or more, and a maximum top face width of 6.0 μm or less; and a belt cleaning section which removes a residual toner remaining on the outer peripheral surface of the intermediate transfer belt after transferring the toner image to a recording medium, the belt cleaning section including:

a cleaning blade formed of a plate-like elastic member, having an abutting side which is a straight end side abutting on the outer peripheral surface of the intermediate transfer belt, and removing a residual toner by abutting on the outer peripheral surface of the intermediate transfer belt, the cleaning blade being provided so as to be parallel to the width direction of the intermediate transfer belt, a side length of the abutting side being longer than a width of the elastic layer in the width direction of the intermediate transfer belt, and a housing which supports end sides other than the abutting side of the cleaning blade and contains a residual toner removed by the cleaning blade.

According to the invention, the intermediate transfer body comprises an intermediate transfer belt which bears and transports a toner image, and a belt cleaning section comprising a cleaning blade which abuts on an outer peripheral surface of the intermediate transfer belt and removes a residual toner. The intermediate transfer belt is an endless belt member comprising a base material and an elastic layer formed on the surface thereof. A plurality of projecting portions extending in parallel with a rotation direction of the intermediate transfer belt are provided on the surface of the elastic layer. The projecting portions each have a minimum projection height of 2.0 μm or more, a maximum projection height of 6.0 μm or less, a minimum top face width of 2.0 μm or more, and a maximum top face width of 6.0 μm or less.

In the intermediate transfer body, the cleaning blade can abut on the outer peripheral surface of the intermediate transfer belt in a state of contacting a top face of the projecting portion having given width and projection height and formed on the surface of the elastic layer, and can remove a residual toner. That is, the cleaning blade can remove a residual toner so as to slide on the top face of the projecting portion without bounding on the outer peripheral surface of the intermediate transfer belt. As a result, the intermediate transfer body prevents a residual toner scraped off by the cleaning blade from scattering, and in addition to this, can obtain uniform cleaning performance to the outer peripheral surface of the intermediate transfer belt by the cleaning blade.

The cleaning blade has an abutting side which is a straight end side abutting on the outer peripheral surface of the intermediate transfer belt in parallel with the width direction of the intermediate transfer belt, and a side length of the abutting side is longer than a width of the elastic layer in the width direction of the intermediate transfer belt. This constitution can prevent that the abutting side abutting on the outer peripheral surface of the intermediate transfer belt in the cleaning blade excessively bites in the inside in a thickness direction of the elastic layer which easily undergoes elastic deformation. As a result, the intermediate transfer body can prevent the occurrence of reversal phenomenon that the cleaning blade rides up according to rotation of the intermediate transfer belt, and can increase removal efficiency of a residual toner.

In the invention, it is preferable that the cleaning blade is formed such that the side length of the abutting side is longer than a length obtained by adding the width of the elastic layer in the width direction of the intermediate transfer belt and a snaking width.

According to the invention, the cleaning blade provided in the intermediate transfer belt is formed such that the side length of the abutting side is longer than a length obtained by adding the width of the elastic layer in the width direction of the intermediate transfer belt and a snaking width. The intermediate transfer belt rotationally conveyed in a state of being supported around a plurality of supporting rollers with tension may be rotationally conveyed while snaking. When the cleaning blade is formed such that the side length of the abutting side in the cleaning blade is longer than the length obtained by adding the width of the elastic layer in the width direction of the intermediate transfer belt and the snaking width, even in the case where the intermediate transfer belt is rotationally conveyed while snaking, the abutting side abutting on the outer peripheral surface of the intermediate transfer belt can be prevented from biting in the inside in the thickness direction of the elastic layer. As a result, even in the case where the intermediate transfer belt is rotationally conveyed while snaking, the intermediate transfer body can obtain uniform cleaning performance to the outer peripheral surface of the intermediate transfer belt, and in addition to this, can prevent the occurrence of reversal phenomenon that the cleaning blade rides up according to the rotation of the intermediate transfer belt, and can increase removal efficiency of a residual toner.

In the invention, it is preferable that the intermediate transfer belt is formed such that a width of the base material in the width direction thereof is longer than the width of the elastic layer, and the cleaning blade is formed such that the side length of the abutting side is shorter than or equal to the width of the base material in the width direction of the intermediate transfer belt.

According to the invention, the cleaning blade provided in the intermediate transfer body is formed such that the side length of the abutting side is shorter than or equal to the width of the base material in the width direction of the intermediate transfer belt. This can prevent the cleaning blade from unnecessarily becoming large, and can make the intermediate transfer body compact.

In the invention, it is preferable that the cleaning blade is provided such that the abutting side abuts on the outer peripheral surface of the intermediate transfer belt under a linear pressure of 14.7 to 44.1 N/m (1.5 to 4.5 gf/mm).

According to the invention, the cleaning blade provided in the intermediate transfer body is provided such that the abutting side abuts on the outer peripheral surface of the intermediate transfer belt under a linear pressure of 14.7 to 44.1 N/m (1.5 to 4.5 gf/mm). This permits the intermediate transfer body to exhibit sufficient cleaning performance to the outer peripheral surface of the intermediate transfer belt. Where the linear pressure of the abutting side in the cleaning blade is less than 14.7 N/m (1.5 gf/mm), the cleaning performance to the outer peripheral surface of the intermediate transfer belt is decreased, and poor cleaning may occur. Where the linear pressure exceeds 44.1 N/m (4.5 gf/mm), reversal phenomenon that the cleaning blade rides up may occur.

In the invention, it is preferable that the abutting side of the cleaning blade abuts such that the elastic layer of the intermediate transfer belt distorts in a ratio of 1.0 to 10% with respect to its thickness.

According to the invention, the abutting side of the cleaning blade provided in the intermediate transfer body abuts such that the elastic layer of the intermediate transfer belt distorts in a ratio of 1.0 to 10% with respect to its thickness. This permits the intermediate transfer body to exhibit sufficient cleaning performance to the outer peripheral surface of the intermediate transfer belt.

The invention provides an image forming apparatus comprising the intermediate transfer body mentioned above.

According to the invention, the image forming apparatus comprises the intermediate transfer body according to the invention comprising the intermediate transfer belt and the belt cleaning section. This permits the image forming apparatus to form a high quality image free of image defects due to poor cleaning of the intermediate transfer belt, stably and over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
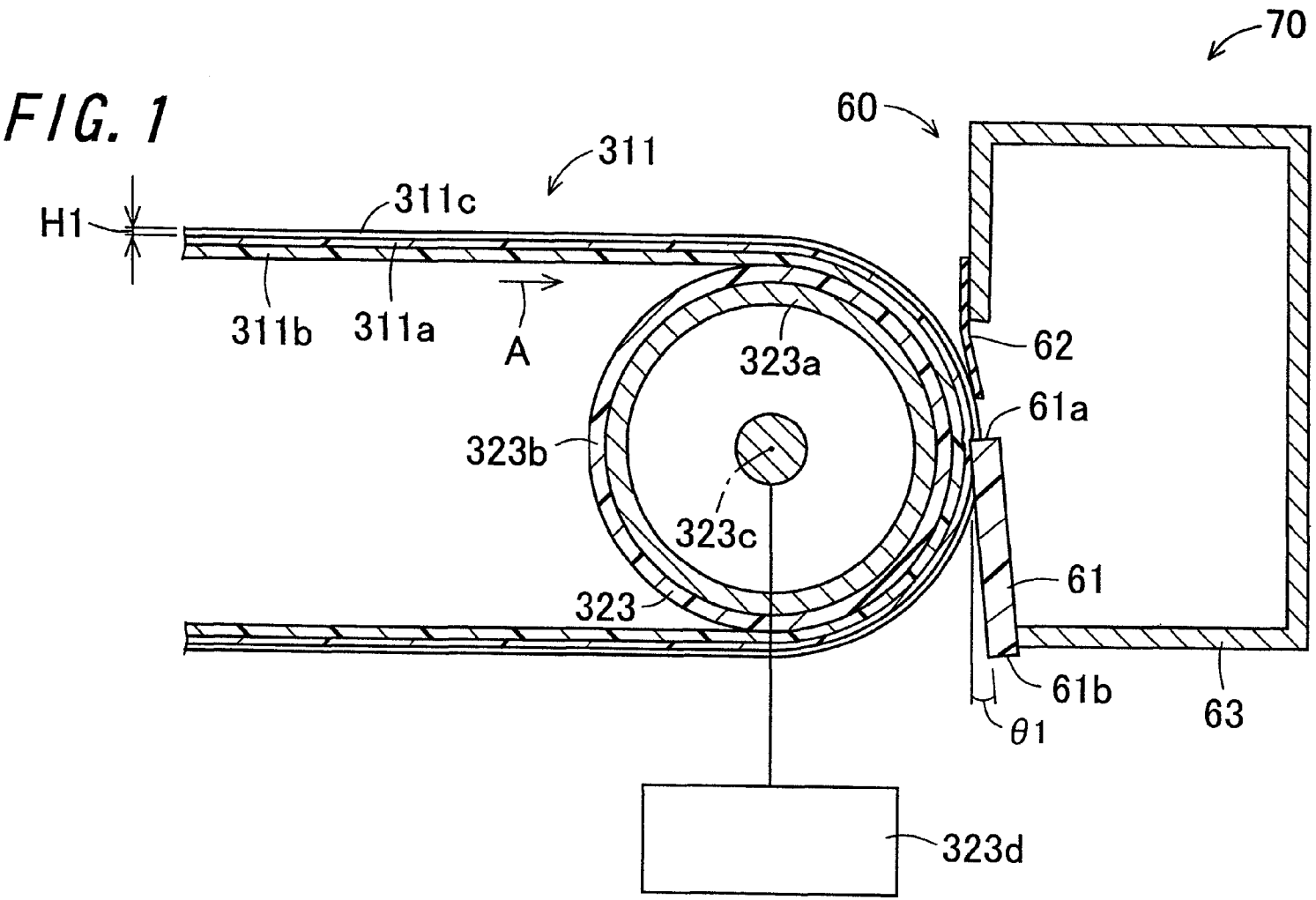
FIG. 1 is a view showing a constitution of an intermediate transfer body according to an embodiment of the invention.

Now referring to the drawings, preferred embodiments of the invention are described below.

(Intermediate Transfer Body)

FIG. 1 is a view showing a constitution of an intermediate transfer body 70 according to an embodiment of the invention. The intermediate transfer body 70 comprises an intermediate transfer belt 311 which bears and transports a toner image, and a belt cleaning section 60 which removes a residual toner remaining on an outer peripheral surface of the intermediate transfer belt 311.

The intermediate transfer belt 311 is constituted so as to be supported around a plurality of supporting rollers with tension. In the present embodiment, the intermediate transfer belt 311 is an endless belt member which is supported with tension around a transfer roller which is one member of constituting members of an image forming apparatus described hereinafter, and an opposed roller 323 to form a loop-like movement route, and is rotationally conveyed in a rotation direction A with the rotation of the opposed roller 323. The opposed roller 323 comprises a cylindrical part 323*a* (thickness 2.0 to 3.0 mm) having on the surface thereof a rubber layer 323*b* (thickness: 100 to 500 μm) for increasing friction force to the intermediate transfer belt 311, and is rotationally driven around a rotation axis 323*c* by a driving section 323*d*.

The intermediate transfer belt 311 in the present embodiment comprises a hollow cylindrical base material 311*b* and an elastic layer 311*a* formed on a surface thereof, and a plurality of projecting portions 311*c* are provided on a surface of the elastic layer 311*a*.

Figure 2A:
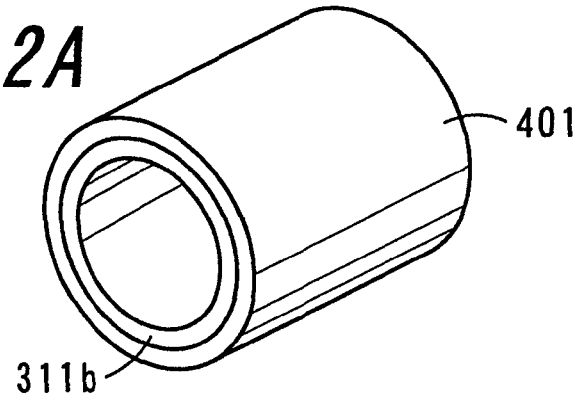
FIGS. 2A to 2C are views showing production procedure of an intermediate transfer belt.
Figure 2B:
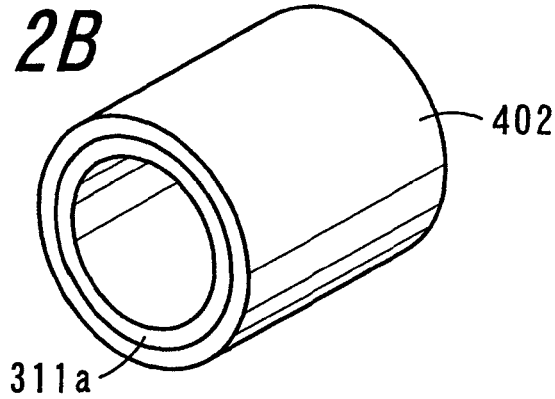
Figure 2C:
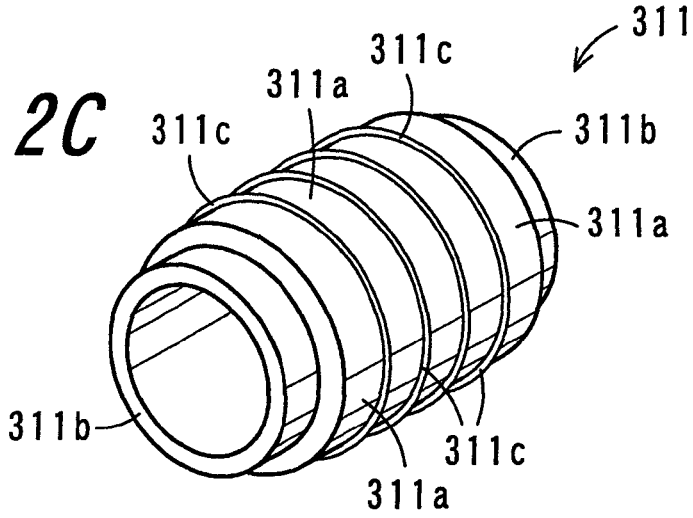
Figure 3:
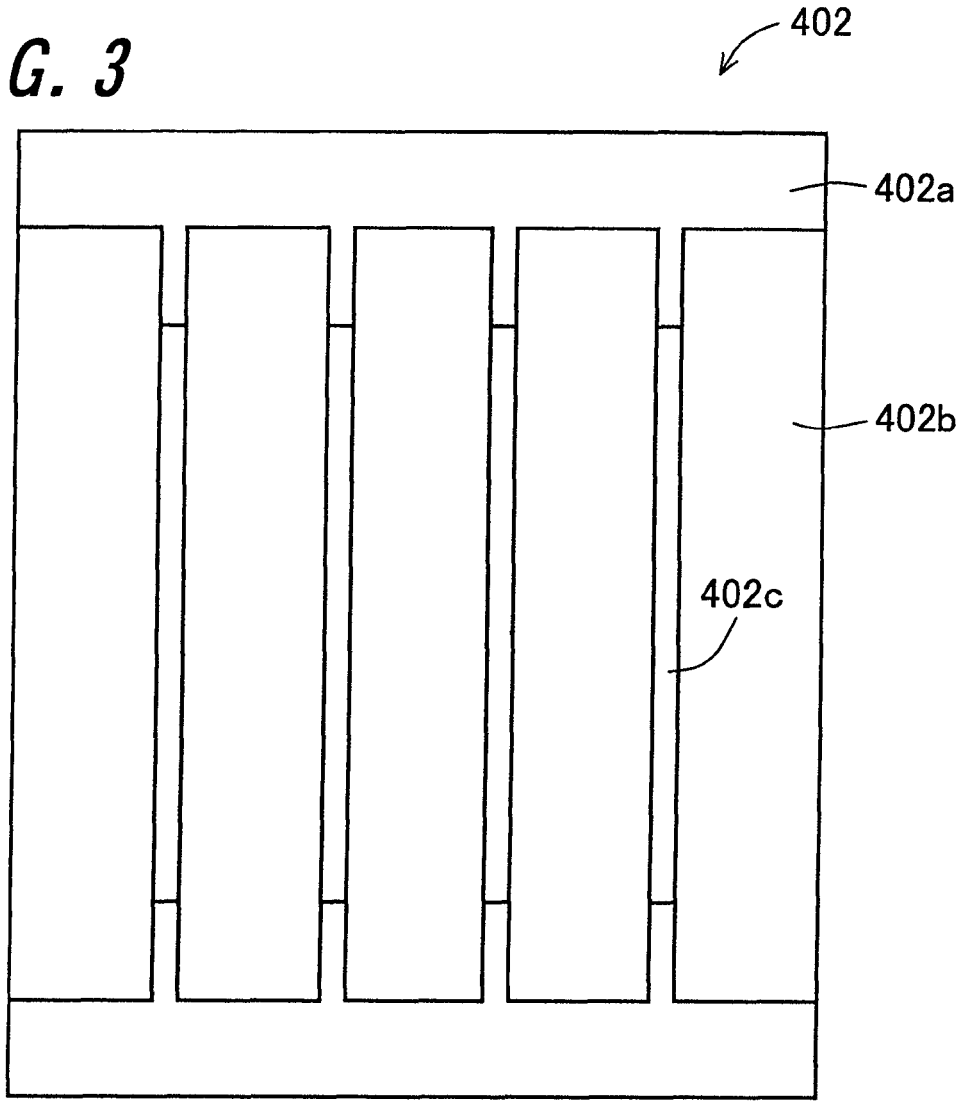
FIG. 3 is a development view of an elastic-layer-dedicated mold used to prepare the elastic layer.

FIGS. 2A to 2C are views showing production procedure of the intermediate transfer belt 311. FIG. 3 is a development view of an elastic-layer-dedicated mold 402 used to prepare the elastic layer 311*a*.

The intermediate transfer belt 311 can be prepared by extrusion molding using a material constituting the base material 311*b* and a material constituting the elastic layer 311*a* and the projecting portions 311*c*. In the case of preparing the intermediate transfer belt 311 having the elastic layer 311*a* having a large film thickness, the intermediate transfer belt is preferably prepared by centrifugal molding as shown in FIGS. 2A to 2C. The intermediate transfer belt 311 having the elastic layer 311*a* is that the elastic layer 311*a* undergoes elastic deformation in response to irregularities of a recording paper sheet, and the intermediate transfer belt 311 and a toner image are contacted so as to cover and wrap a toner image. This can make transferability good. In the intermediate transfer belt 311 having the elastic layer 311*a*, a surface of the elastic layer 311*a* is a toner image-bearing region. A toner constituting a toner image has a volume average particle size of 5 to 10 μm.

In the case of preparing the intermediate transfer belt 311 by centrifugal molding, the base material 311*b* is first prepared by demolding the same from a base-material-dedicated mold 401 after centrifugal molding using a constituent material of the base material 311*b*, as shown in FIG. 2A. Next, a constituent material of the elastic layer 311*a* and the projecting portions 311*c* is applied to an inner surface of a cylindrical elastic-layer-dedicated mold 402 to be rotated, and the material is demolded from the elastic-layer-dedicated mold 402, thereby preparing the elastic layer 311*a* having formed thereon the projecting portions 311*c*, as shown in FIG. 2B. The inside of the elastic-layer-dedicated mold 402 is constituted of a reference level 402*a* which is a surface of reference, a first concave portion 402*b* which is a concave portion corresponding to a thickness of the elastic layer 311*a* from the reference level 402*a*, and a second concave portion 402*c* which is a concave portion corresponding to a projection height of the projecting portion 311*c* from the first concave portion 402*b*, as shown in FIG. 3. The elastic layer 311*a* having formed thereon the projecting portions 311*c* can be prepared by using the elastic-layer-dedicated mold 402 thus constituted.

The intermediate transfer belt 311 can be prepared by covering the base material 311*b* with the elastic layer 311*a* having formed thereon the projecting portions 311*c*, as shown in FIG. 2C.

The base material 311*b* of the intermediate transfer belt 311 is made of a resin such as polyimide, polycarbonate, polybutylene terephthalate (PBT), a mixed resin of nylon with polyphenylene sulfide (PPS), or polyamide imide. The base material 311*b* has a thickness of 80 μm, a volume resistivity of $10^{10}$ Ω·cm, and a surface resistivity of $10^{10}$ Ω/square.

The elastic layer 311*a* and the projecting portion 311*c* of the intermediate transfer belt 311 are made of chloroprene rubber (CR rubber), urethane rubber or the like. The elastic layer 311*a* preferably has a thickness of 100 to 400 μm.

Where the thickness of the elastic layer 311*a* is less than 100 μm, the elastic layer 311*a* has poor elastic deformability in response to irregularities of a recording paper sheet, and the effect of improving transferability is not sufficient. Where the thickness of the elastic layer 311*a* exceeds 400 μm, such a thickness affects rotating circumferential velocity of the intermediate transfer belt 311, and balance in circumferential velocity between a linear region portion and a curvature portion contacting a transfer roller and the opposed roller 323, in the intermediate transfer belt 311 are deteriorated. As a result, image transfer deviation and conveyance failure of a recording paper sheet may be generated.

Figure 4:
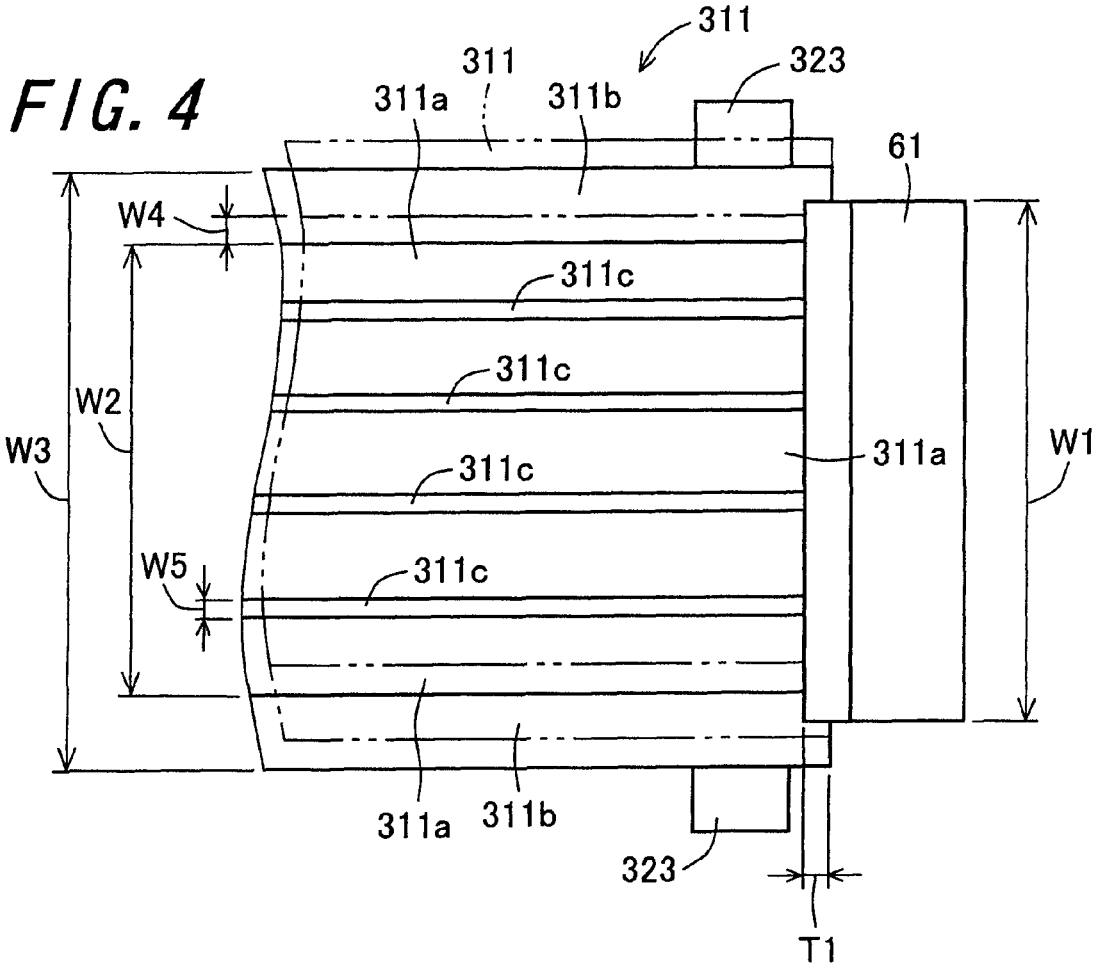
FIG. 4 is a view showing a positional relationship between a cleaning blade and the intermediate transfer belt in the case of seeing from a direction perpendicular to the surface of the intermediate transfer belt.
Figure 5:
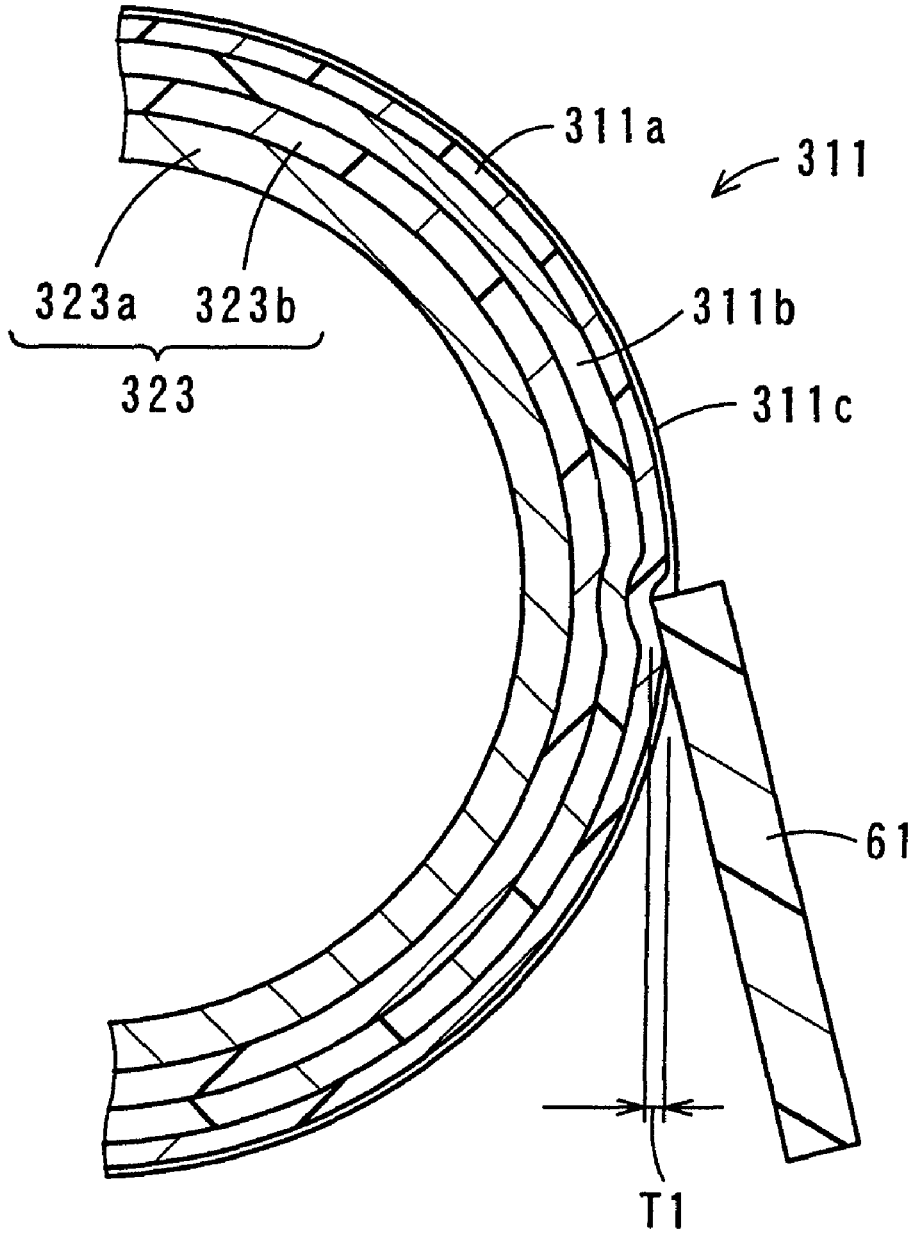
FIG. 5 is a view showing a positional relationship between a cleaning blade and the intermediate transfer belt in the case of seeing from a width direction of the intermediate transfer belt.

Returning to FIG. 1, the projecting portions 311*c* formed on the surface of the elastic layer 311*a* are described in detail below. FIG. 4 is a view showing a positional relationship between a cleaning blade 61 and the intermediate transfer belt 311 in the case of seeing from a direction perpendicular to the surface of the intermediate transfer belt 311. FIG. 5 is a view showing a positional relationship between a cleaning blade 61 and the intermediate transfer belt 311 in the case of seeing from a width direction of the intermediate transfer belt 311.

The projecting portions 311*c* project outwardly from the surface of the elastic layer 311*a*, extends in parallel with the rotation direction A of the intermediate transfer belt 311, and is provided over an entire periphery of the elastic layer 311*a*. In the present embodiment, four projecting portions 311*c* are formed side by side in the width direction of the intermediate transfer belt 311 with an equal interval (60 to 70 mm). A cross-sectional shape of each projecting portion 311*c* is not particularly limited, and can be selected from semicircle, trapezoid, square, rectangle and the like. In the present embodiment, the cross-sectional shape is square.

The projecting portions 311*c* each has a top face width W5 of a minimum value of 2.0 μm or more and a maximum value of 6.0 μm or less. Furthermore, the projecting portions 311*c* each have a projection height H1 of a minimum value of 2.0 μm or more and the maximum value of 6.0 μm or less.

In the intermediate transfer body 70, a cleaning blade 61 described hereinafter abuts on the outer peripheral surface of the intermediate transfer belt 311 in a state of contacting a top face of the projecting portion 311*c* having the given width and projection height formed on the surface of the elastic layer 311*a*, thereby a residual toner can be removed. Specifically, the cleaning blade 61 can remove a residual toner so as to slide on the top face of the projecting portion 311*c* without bounding on the outer peripheral surface of the intermediate transfer belt 311. As a result, the intermediate transfer body 70 prevents a residual toner scraped off by the cleaning blade 61 from scattering, and in addition to this, can obtain uniform cleaning performance to the outer peripheral surface of the intermediate transfer belt 311 by the cleaning blade 61.

When the cleaning blade 61 abuts on the outer peripheral surface of the intermediate transfer belt 311 and removes a residual toner, the projecting portion 311*c* undergoes pressure deformation by a pressure force of the cleaning blade 61, and its height and width vary.

It is necessary to set up the top face width W5 and the projection height H1, considering the pressure deformation of the projecting portion 311*c*, and a residual toner originated from a toner having a volume average particle size of 5 to 10 μm can sufficiently be removed by setting the width W5 and the projection height H1 to the above-described ranges.

The present embodiment has the constitution that the projecting portions 311*c* are provided over the entire circumference, extending in parallel in the rotation direction A of the intermediate transfer belt 311. However, it is not always necessary that the projecting portions 311*c* are provided over the entire circumference in the rotation direction A, and the projecting portions 311*c* may partly be provided in the rotation direction A.

The intermediate transfer belt 311 may have a coat layer (thickness: 3 to 10 μm) made of a fluorine resin such as PTFE (polytetrafluoroethylene) on the surface of the elastic layer 311*a* having formed thereon the projecting portions 311*c*.

The intermediate transfer body 70 comprises a belt cleaning section 60 which removes a residual toner remaining on the outer peripheral surface of the intermediate transfer belt 311. The belt cleaning section 60 comprises a cleaning blade 61, a scoop seal 62 and a waste toner case 63 which is a housing.

The cleaning blade 61 is a plate-like member made of an elastic material, and is provided so as to abut on the outer peripheral surface of the intermediate transfer belt 311. The elastic material is appropriately selected from materials having appropriate elasticity such as a synthetic resin and a rubber. The cleaning blade 61 has an abutting side which is a straight edge side abutting on the outer peripheral surface of the intermediate transfer belt 311 in parallel with the width direction of the intermediate transfer belt 311. In the present embodiment, the cleaning blade 61 is a rectangular plate-like elastic member made of a urethane rubber, and its thickness is about 2 mm.

A longitudinal direction of the cleaning blade 61 which is a rectangular plate-like elastic member is the width direction of the intermediate transfer belt 311, and a direction perpendicular to the longitudinal direction is a lateral direction of the cleaning blade 61. In such a cleaning blade 61, one end 61*a* in the lateral direction is an abutting side abutting the outer peripheral surface of the intermediate transfer belt 311. The cleaning blade 61 is supported by the waste toner case 63 by connecting the other end 61*b* in the lateral direction to an open end of the waste toner case 63.

In the present embodiment, one end 61*a* in the lateral direction of the cleaning blade 61 is provided so as to abut on the outer peripheral surface in a region contacting the opposed roller 323 of the intermediate transfer belt 311. The cleaning blade 61 is provided such that a direction toward the one end 61*a* in the lateral direction from the other end 61*b* in the lateral direction is a direction opposing the rotation direction A of the intermediate transfer belt 311.

The cleaning blade 61 thus constituted abuts on the outer peripheral surface in a region that the one end 61*a* in the lateral direction contacts the opposed roller 323 of the intermediate transfer belt 311 in an elastically deformed state, mechanically scrapes off a residual toner remaining on the outer peripheral surface of the intermediate transfer belt 311 after transfer treatment, and cleans the outer peripheral surface of the intermediate transfer belt 311.

The cleaning blade 61 is formed such that a width in the longitudinal direction, that is, the width (side length of abutting side) W1 of the one end 61*a* in the lateral direction, is longer than a width W2 of the elastic layer 311*a* in the width direction of the intermediate transfer belt 311. This can prevent that the one end 61*a* in the lateral direction which is an abutting portion to the outer peripheral surface of the intermediate transfer belt 311 in the cleaning blade 61 excessively bites in the inside in a thickness direction of the elastic layer 311*a* which easily undergoes elastic deformation. As a result, the intermediate transfer body 70 can obtain uniform cleaning performance to the outer peripheral surface of the intermediate transfer belt 311, and in addition to this, can prevent occurrence of reversal phenomenon that the cleaning blade 61 rides up according to the rotation of the intermediate transfer belt 311, thereby removal efficiency of a residual toner can be increased. Furthermore, due to the prevention of reversal phenomenon of the cleaning blade 61, the cleaning blade 61 and the intermediate transfer belt 311 can be prevented from damaging.

The proportion of the width W1 of the one end 61*a* in the lateral direction in the cleaning blade 61 to the width W2 of the elastic layer 311*a* ((W1/W2)×100) is preferably set to be larger than 100% and 105% or less.

The cleaning blade 61 is preferably formed such that the width W1 of the one end 61*a* in the lateral direction is longer than a length obtained by adding the width W2 of the elastic layer 311*a* in the width direction of the intermediate transfer belt 311 and a snaking width W4. In some cases, the intermediate transfer belt 311 which is rotationally conveyed in a state of being supported around the opposed roller 323 and a transfer roller with tension is rotationally conveyed while snaking. When the cleaning blade 61 is formed such that the width W1 of the one end 61*a* in the lateral direction in the cleaning blade 61 is longer than the length obtained by adding the width W2 of the elastic layer 311*a* in the width direction of the intermediate transfer belt 311 and the snaking width W4, the one end 61*a* in the lateral direction which is an abutting portion to an outer peripheral surface of the intermediate transfer belt 311 can be prevented from excessively biting in the inside in a thickness direction of the elastic layer 311*a* even in the case the intermediate transfer belt 311 is rotationally conveyed while snaking. As a result, even in the case where the intermediate transfer belt 311 is rotationally conveyed while snaking, the intermediate transfer body 70 can obtain uniform cleaning performance to the outer peripheral surface of the intermediate transfer belt 311, and in addition to this, can prevent the occurrence of reversal phenomenon that the cleaning blade 61 rides up according to the rotation of the intermediate transfer belt 311, and can increase removal efficiency of a residual toner.

The cleaning blade 61 is preferably formed such that the width W1 of the one end 61*a* in the lateral direction is shorter than or equal to a width W3 of the base material 311*b* in the width direction of the intermediate transfer belt 311. This can prevent the cleaning blade 61 from being unnecessarily large, and can make the intermediate transfer body 70 compact.

The cleaning blade 61 is preferably provided such that the one end 61*a* in the lateral direction thereof abuts on the outer peripheral surface of the intermediate transfer belt 311 under a linear pressure of 14.7 to 44.1 N/m (1.5 to 4.5 gf/mm). This permits the intermediate transfer body 70 to exhibit sufficient cleaning performance to the outer peripheral surface of the intermediate transfer belt 311. Where the linear pressure of the one end 61*a* in the lateral direction of the cleaning blade 61 is less than 14.7 N/m (1.5 gf/mm), the cleaning performance to the outer peripheral surface of the intermediate transfer belt 311 is decreased, and poor cleaning may occur. Where the linear pressure exceeds 44.1 N/m (4.5 gf/mm), reversal phenomenon that the cleaning blade 61 rides up may occur.

The cleaning blade 61 preferably abuts on the intermediate transfer belt 311 such that the elastic layer 311*a* of the intermediate transfer belt 311 distorts in a proportion of 1.0 to 10% with respect to its thickness. Specifically, it is preferred that the cleaning blade 61 is provided to be in contact with the opposed roller 323 having a rubber layer 323*b* having a thickness of 100 to 500 μm, and the one end 61*a* in the lateral direction thereof abuts on the intermediate transfer belt 311 comprising the base material 311*b* and the elastic layer 311*a* having a thickness of 100 to 400 μm formed on the surface of the intermediate transfer belt 311 so that the outer peripheral surface of the intermediate transfer belt 311 is distorted in a range of 0.8 to 1.5 mm in its thickness direction.

This constitution permits the intermediate transfer body 70 to exhibit sufficient cleaning performance to the outer peripheral surface of the intermediate transfer belt 311. Where the one end 61*a* in the lateral direction in the cleaning blade 61 is that a distortion amount T1 by abutting on the outer peripheral surface of the intermediate transfer belt 311 is less than 0.8 mm, cleaning performance to the outer peripheral surface of the intermediate transfer belt 311 is decreased, and poor cleaning may occur. Where the distortion amount T1 exceeds 1.5 mm, reversal phenomenon that the cleaning blade 61 rides up may occur.

The cleaning blade 61 is preferably that in a virtual plane vertical to the width direction of the intermediate transfer belt 311, an abutting angle θ1 which is an angle formed by an extended line in the lateral direction extending toward the outer peripheral surface of the intermediate transfer belt 311 and a tangent line of the intermediate transfer belt 311 extending toward a downstream side in the rotation direction of the intermediate transfer belt 311 from an abutting position of the one end 61*a* in the lateral direction thereof to the outer peripheral surface of the intermediate transfer belt 311 is preferably 7.0 to 13.0°. This permits the intermediate transfer body 70 to exhibit sufficient cleaning performance to the outer peripheral surface of the intermediate transfer belt 311. Where the abutting angle θ1 is less than 7.0°, the cleaning performance to the outer peripheral surface of the intermediate transfer belt 311 is decreased, and poor cleaning may occur. On the other hand, where the abutting angle θ1 exceeds 13.0°, reversal phenomenon that the cleaning blade 61 rides up may occur.

The waste toner case 63 is a container-like member for collecting a residual toner scraped off from the intermediate transfer belt 311 by the cleaning blade 61 as a waste toner. The waste toner collected in the waste toner case 63 is sent to a waste toner disposal bottle (not shown) by a waste toner conveying screw (not shown). The other end 61*b* in the lateral direction of the cleaning blade 61 is connected to the open end of the waste toner case 63.

The scoop seal 62 has its one end in a lateral direction thereof which lightly abuts on the outer peripheral surface of the intermediate transfer belt 311 in a region contacting the opposed roller 323 in an upstream side in the rotation direction of the intermediate transfer belt 311 to the cleaning blade 61, and allows a residual toner on the outer peripheral surface of the intermediate transfer belt 311 to pass to the abutting part of the cleaning blade 61 without scraping off the residual toner. The scoop seal 62 prevents a waste toner scraped off by the cleaning blade 61 and collected in the waste toner case 62 from leaking out of the waste toner case 63. In the present embodiment, the scoop seal 62 is made of an urethane rubber sheet having a thickness of 0.1 mm. The other end in the lateral direction of the scoop seal 62 is connected to the open end of the waste toner case 63.

According to the intermediate transfer body 70 constituted as above, the cleaning blade 61 can remove a residual toner so as to slide on a top face of the projecting portion 311*c* without bounding on the outer peripheral surface of the intermediate transfer belt 311. Furthermore, the intermediate transfer body 70 can clean the outer peripheral surface of the intermediate transfer belt 311 having the elastic layer 311*a* which easily undergoes elastic deformation, without occurrence of riding up (reversal) of the cleaning blade 61, and can contribute to stably forming a high quality image free of occurrence of image defects due to poor cleaning.

(Image Forming Apparatus)

Figure 6:
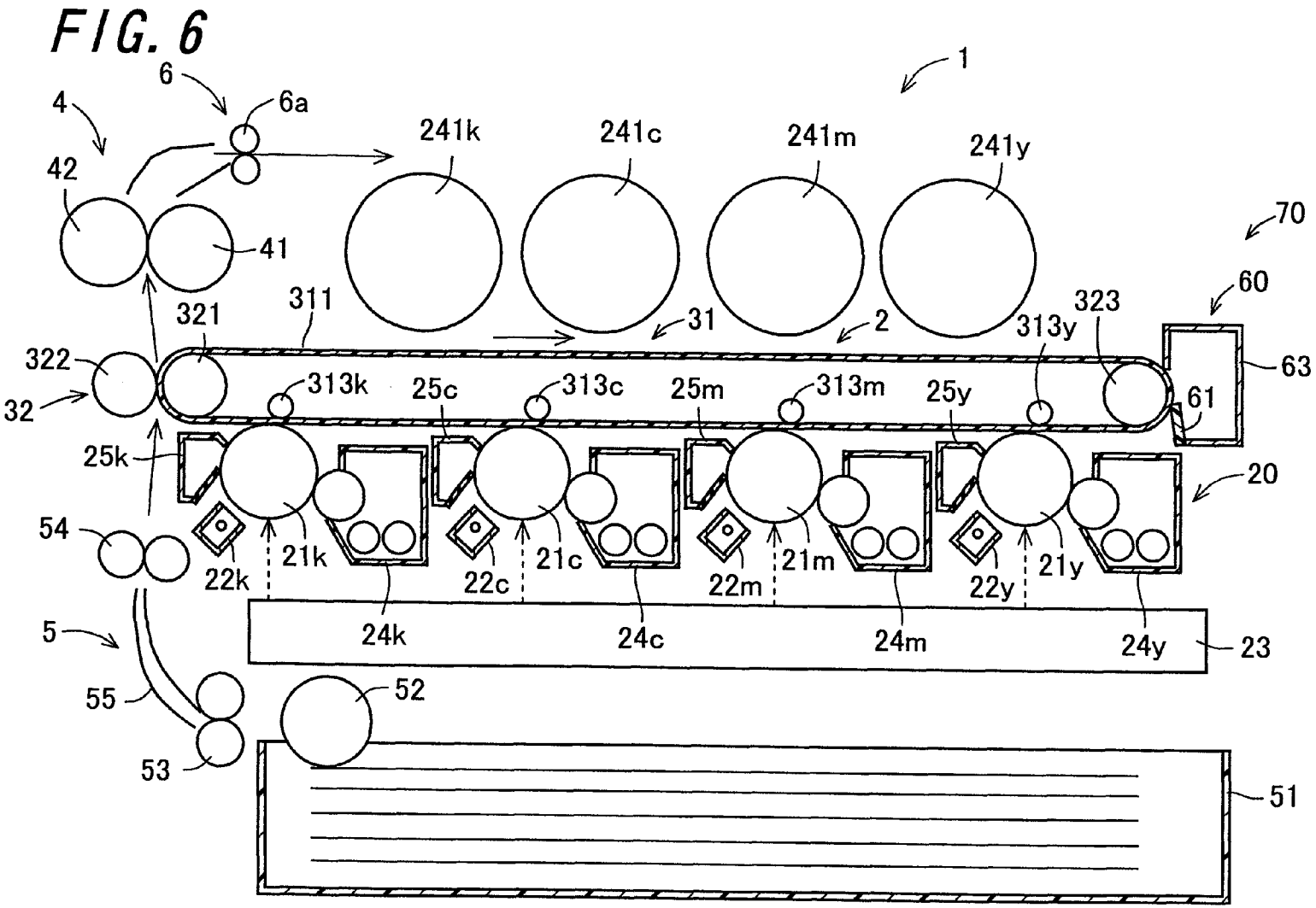
FIG. 6 is a view showing a constitution of an image forming apparatus according to an embodiment of the invention.

FIG. 6 is a view showing a constitution of an image forming apparatus 1 according to an embodiment of the invention. The image forming apparatus 1 is a tandem color image forming apparatus enabling formation of a color image. The image forming apparatus 1 has a printer function which forms a color image or a monochrome image on a recording paper sheet as a recording medium based on image data transmitted from various terminal devices such as PC (Personal Computer) connected through network and image data read by a document reader such as a scanner.

The image forming apparatus 1 comprises an image forming station part 2 having a toner image forming part 20 and a primary transfer part 31, a secondary transfer station part 32, a fixing section 4, a paper feeding section 5, and a paper discharge section 6. The image forming station part 2 is divided into four image forming stations for yellow image, for magenta image, cyan image and black image in order to respond to image information of each color of yellow (y), magenta (m), cyan (c) and black (k). The image forming stations for yellow image, for magenta image, cyan image and black image are juxtaposed in this order in the rotation direction of the intermediate transfer belt 311 described hereinafter.

The four image forming stations for yellow image, for magenta image, cyan image and black image have substantially the same constitution, respectively, form yellow, magenta, cyan and black images based on image information corresponding to each color, overlay those images on the intermediate transfer belt 311 to form an image composed of four color toners, and transfer the toner image to a recording paper sheet in the secondary transfer station part 32. The toner image on the recording paper sheet is pressed under application of heat in the fixing section 4, thereby forming a full color image on the recording paper sheet.

Four members are provided for each member constituting the image forming station part 2, respectively, in order to respond to image information of each color of black (k), cyan (c), magenta (m) and yellow (y) contained in color image information. Each member (every four members are provided to respond to each color), is distinguished by adding an alphabet showing each color to the end of the reference numeral. In the case of generic name, only reference numeral is shown.

The image forming station part 2 comprises the toner image forming part 20 and the primary transfer part 31. The toner image forming part 20 comprises a photoreceptor 21, a charging section 22, an exposure unit 23, a developing section 24, and a cleaner 25. The charging section 22, the developing section 24 and the cleaner 25 are arranged along a rotation direction of the photoreceptor 21 in this order.

The photoreceptor 21 has a substantially cylindrical drum shape having a photosensitive material such as OPC (Organic Photoconductor) on a surface thereof, is arranged upside the exposure unit 23, and is controlled so as to rotationally drive in a given direction by a driving section and a control section. The charging section 22 is a scorotron charger for uniformly charging the surface of the photoreceptor 21 in a given potential, and is arranged close to the outer peripheral surface of the photoreceptor 21.

The exposure unit 23 has a function of decreasing potential of an exposed part on the surface of the photoreceptor 21 by irradiating the surface of the photoreceptor 21 charged by the charging section 22 with laser light for the purpose of exposure, and writing in and forming an electrostatic latent image corresponding to image data on the surface of the photoreceptor. The exposure unit 23 forms an electrostatic latent image in response to the corresponding each color by inputting image data responding to yellow, magenta, cyan or black according to the image forming station corresponding to each color. The exposure unit 23 can use a laser scanning unit (LSU) equipped with a laser irradiation part and a reflective mirror, and a writing device (for example, writing head) having light-emitting elements such as EL (Electro Luminescence) and LED (Light Emitting Diode) arranged in, an array form.

The developing section 24 comprises a developing roller serving as a developer bearing member bearing a developer thereon, and a developer tank containing a developer. In the embodiment, a two-component developer containing a toner and a carrier is used, and an electrostatic latent image formed on the surface of the photoreceptor 21 by the exposure unit 32 is reversely developed with the toner, thereby forming a toner image. The developer used is not limited to a two-component developer, and a one-component developer can be used. The developing section 24 further comprises a toner bottle 241 which contains the respective toner corresponding to the each color and replenishes a toner to the developer tank according to consumption amount of a toner. The developing roller is constituted such that a toner transports a developer to a development region that a toner can moves to the photoreceptor 21. The toner in the developer contained in the developer tank is charged in the same polarity as the surface potential charged in the photoreceptor 21. Polarity of the surface potential charged in the photoreceptor 21 and charged polarity of a toner used are all negative.

The cleaner 25 removes and collects a toner remaining on the outer peripheral surface of the photoreceptor 21 after transferring a toner image to the intermediate transfer belt 311, and in the cleaner, a cleaning blade made of a urethane rubber abuts on the surface of the photoreceptor 21.

The primary transfer part 31 comprises the intermediate transfer body 70 comprising the intermediate transfer belt 311 and the belt cleaning section 60, and a primary transfer roller 313.

As mentioned above, the intermediate transfer belt 311 is an endless belt member which is supported with tension around the transfer roller 321 which is one member of constituent members of the secondary transfer station as described above and the opposed roller 323 arranged so as to face the cleaning blade 61 of the belt cleaning section 60 to form a loop-like movement path, and is rotationally driven with the rotation of the opposed roller 323.

When the intermediate transfer belt 311 passes by the photoreceptor 21 while contacting the photoreceptor 21, transfer bias of reverse polarity (straight polarity) from the charged polarity of a toner on the surface of the photoreceptor 21 is applied from the primary transfer roller 313 arranged facing the photoreceptor 21 with the intermediate transfer belt 311 interposed therebetween, and a toner image formed on the surface of the photoreceptor 21 is transferred to the intermediate transfer belt 311 and borne thereon.

The intermediate transfer belt 311 bears a toner image composed of a four-color toner in a toner image bearing region (elastic layer 311*a*) of the surface thereof by registering and overlaying toner images formed on the respective photoreceptors 21 of the image forming stations for the respective colors. The toner image composed of a four-color toner borne on the outer peripheral surface of the intermediate transfer belt 311 is conveyed to the secondary transfer station part 32 by the rotation of the intermediate transfer belt 311.

The belt cleaning section 60 removes and collects a residual toner remaining on the outer peripheral surface of the intermediate transfer belt 311 after transferring a toner image to a recording paper sheet in the secondary transfer station part 32.

In the secondary transfer station part 32, a secondary transfer roller 322 is arranged facing a transfer roller 321 suspending the intermediate transfer belt 311, with the intermediate transfer belt 311 interposed therebetween. The transfer roller 321 is rotatably supported about a rotation axis through ball bearings by providing a conductive resin flange in a cylindrical end of aluminum (A5052) having an outer diameter of 30 mm and a thickness of 0.8 mm. The transfer roller 321 is rotated with the rotation of the intermediate transfer belt 311. The secondary transfer roller 322 comes in pressure-contact with the intermediate transfer belt 311, with a recording paper sheet fed and conveyed by a paper feeding section 5 interposed therebetween, in synchronization with transportation of a toner image borne on the intermediate transfer belt 311. The pressure-contact portion between the secondary transfer roller 322 and the intermediate transfer belt 311 is a transfer nip region. When the toner image borne on the intermediate transfer belt 311 and the recording paper sheet pass through the transfer nip region in synchronization with each other, positive electric potential (transfer electric field) attracting a toner is applied to the secondary transfer roller 322, and a toner image on the intermediate transfer belt 311 is transferred to the recording paper sheet.

The fixing section 4 is arranged at a downstream side in a recording paper conveyance direction with respect to the secondary transfer station part 32, and comprises a heating roller 41 and a pressure roller 42. The heating roller 41 is provided so as to be rotatable by a driving section (not shown). The heating roller 41 heats a toner constituting a toner image transferred to and borne on a recording paper sheet, and fuses the toner. A heating section (not shown) is provided in an inside of the heating roller 41. The heating section heats the heating roller 41 such that a surface of the heating roller 41 reaches a given temperature (heating temperature). The heating part can use a heater, a halogen lamp and the like.

The pressure roller 42 is provided so as to be in pressure-contact with the heating roller 41, and is supported so as to be rotatable according to rotation drive of the heating roller 41. The pressure roller 42 fixes a toner image to a recording paper sheet in cooperation with the heating roller 41. At this time, the pressure roller 42 presses the toner in a fused state due to heat from the heating roller 41 against the recording paper sheet, thereby assisting fixation of the toner image to the recording paper sheet. A pressure-contact portion between the heating roller 41 and the pressure roller 42 is a fixing nip region. According to the fixing section 4, a recording paper sheet having a toner image transferred thereto in the secondary transfer station part 32 is nipped by the heating roller 41 and the pressure roller 42, and when the recording paper sheet passes through the fixing nip region, the toner image is pressed against the recording paper sheet under heating, thereby fixing the toner image to the recording paper sheet. Thus, an image is formed.

The paper feeding section 5 comprises a paper feed tray 51, a pickup roller 52, registration rollers 53, conveying rollers 54, and a paper sheet guide 55. The paper feed tray 51 is provided at a lower part in a vertical direction of the image forming apparatus 1, and is a container-like member which stores recording paper sheets. Examples of the recording paper that can be used include plain papers, color copying papers, sheets for overhead projector, and post cards.

The pickup roller 52 picks up the recording paper sheets stored in the paper feed tray 51 sheet by sheet, and sends the recording paper sheet toward the registration rollers 53. The registration rollers 53 are a pair of roller members provided so as to be in pressure-contact with each other, and sends the recording paper sheet sent from the pickup roller 52 to the paper sheet guide 55 defining a recording paper sheet conveyance path such that the recoding paper sheet is sent to the transfer nip region in synchronization with the toner image borne on the intermediate transfer belt 311 being conveyed to the transfer nip region. The recording paper sheet sent to the paper sheet guide 55 is conveyed to the conveying rollers 54 which are a pair of roller members provided so as to be in pressure-contact with each other, and then conveyed to the transfer nip region.

The paper discharge section 6 comprises discharge rollers **6*a*. The discharge rollers 6*a* are provided at a downstream side with respect to the fixing nip region in the fixing section 4 in the paper sheet conveyance direction, and discharges a recording paper sheet having an image fixed thereto by the fixing section 4, to a catch tray provided at an upper side in a vertical direction of the image forming apparatus 1**. The catch tray stores recording paper sheets each having an image fixed thereto.

According to the image forming apparatus 1 constituted as above, high quality image free of image defects due to poor cleaning of the intermediate transfer belt 311 can be formed stably over a long period of time by providing the intermediate transfer body 70 comprising the intermediate transfer belt 311 and the belt cleaning section 60.

EXAMPLES

The invention is specifically described below by reference to examples and comparative examples. Intermediate transfer bodies of Examples 1 to 5 described below and intermediate transfer bodies of Comparative Examples 1 to 4 described below were mounted on a color multifunctional peripheral MX-7001N, manufactured by Sharp Corporation, and riding-up property of a cleaning blade, cleaning property and back contamination of a paper sheet were evaluated.

<Riding-Up Property of Cleaning Blade>

The color multifunctional peripheral was operated until printed recording paper sheets reach 100,000 sheets. Whether or not reversal phenomenon that a cleaning blade rides up according to the rotation of an intermediate transfer belt occurred was visually observed every 10,000 printed sheets. The evaluation standard is as follow.

Excellent: Reversal phenomenon of cleaning blade does not occur even at the time that printed sheets reached 100,000 sheets.

Good: Reversal phenomenon of cleaning blade occurred at the time that printed sheets reached 100,000 sheets. However, reversal phenomenon of cleaning blade does not occur up to 90,000 printed sheets.

Fair: Reversal phenomenon of cleaning blade occurred at the time that printed sheets reached 50,000 to 90,000 sheets.

Poor: Reversal phenomenon of cleaning blade occurred at printed sheets of 50,000 sheets or less.

<Cleaning Property>

The color multifunctional peripheral was operated until printed recording paper sheets reach 100,000 sheets. Whether or not vertical stripes occurred in a printed image and an intermediate transfer belt was visually observed every 10,000 printed sheets. The evaluation standard is as follow.

Excellent: Vertical stripes do not occur in a printed image and an intermediate transfer belt even at the time that printed sheets reached 100,000 sheets.

Good: Vertical stripes do not occur in a printed image at the time that printed sheets reached 90,000 sheets, but slight stripes occurred in an intermediate transfer belt.

Fair: Vertical stripes having a width of 0.5 mm occurred at both ends of a printed image at the time that printed sheets reached 50,000 to 90,000 sheets.

Poor: Vertical stripes having a width of 2 mm occurred at both ends of a printed image at printed sheets of 50,000 sheets or less.

Example 1

An intermediate transfer belt and a cleaning blade were constituted as follows.

[Intermediate Transfer Belt]

An intermediate transfer belt has an elastic layer formed on a central portion in a width direction on a surface of a base material made of polyimide, having a width of 357 mm, which elastic layer is made of a urethane rubber having a width of 337 mm, a thickness of 150 μm and a surface roughness (arithmetic average roughness Ra) of 3 nm, and four projecting portions formed on a surface of the elastic layer. The four projecting portions are provided in parallel with the rotation direction (perpendicular to the width direction) of the intermediate transfer belt and with an equal interval (interval width: 70 mm) in the width direction thereof. The projecting portions each have its sectional shape of rectangular, as well as the minimum width of 3.0 μm, the maximum width of 4.5 μm, the minimum projection height of 3.0 μm, and the maximum projection height of 4.5 μm.

The intermediate transfer belt is rotationally conveyed at a rotating circumferential speed of 220 mm/sec, and a snaking width was within a range of 0.5 to 3 mm.

[Cleaning Blade]

A urethane rubber blade having a longitudinal direction width of 340 mm, a lateral direction width of 9.0 mm, a thickness of 2.0 mm and Young's modulus of 8.53 MPa (870 gf/mm$^2$) was used as a cleaning blade. The cleaning blade was arranged such that one end (abutting side) in a lateral direction of the cleaning blade abuts on a region contacting an opposed roller in an outer peripheral surface of the intermediate transfer belt. Here, the cleaning blade was placed in a direction opposing a rotation direction of the intermediate transfer belt, an abutting angle to the intermediate transfer belt was 9.2°, an abutting pressure (linear pressure) was 28.4 N/m (2.9 gf/mm), and distortion amount of the elastic layer was 1.2 mm.

Example 2

[Intermediate Transfer Belt]

An intermediate transfer belt was constituted in the same manner as the intermediate transfer belt in Example 1, except that a thickness of the elastic layer is 250 μm.

[Cleaning Blade]

A cleaning blade was constituted in the same manner as the cleaning blade in Example 1, except that a longitudinal direction width is 341 mm.

Example 3

[Intermediate Transfer Belt]

An intermediate transfer belt was constituted in the same manner as the intermediate transfer belt in Example 1, except that a thickness of the elastic layer is 400 μm.

[Cleaning Blade]

A cleaning blade was constituted in the same manner as the cleaning blade in Example 1, except that a longitudinal direction width is 342 mm.

Example 4

[Intermediate Transfer Belt]

An intermediate transfer belt was constituted in the same manner as the intermediate transfer belt in Example 1, except that a thickness of the elastic layer is 75 μm, and each projecting portion formed on a surface of the elastic layer has the minimum width of 2.0 μm, the maximum width of 4.0 μm, the minimum projection height of 2.0 μm, and the maximum projection height of 4.0 μm.

[Cleaning Blade]

A cleaning blade was constituted in the same manner as the cleaning blade in Example 1.

Example 5

[Intermediate Transfer Belt]

An intermediate transfer belt was constituted in the same manner as the intermediate transfer belt in Example 1, except that a thickness of the elastic layer is 420 μm, and each projecting portion formed on a surface of the elastic layer has the minimum width of 4.0 μm, the maximum width of 6.0 μm, the minimum projection height of 4.0 μm, and the maximum projection height of 6.0 μm.

[Cleaning Blade]

A cleaning blade was constituted in the same manner as the cleaning blade in Example 1.

Comparative Example 1

[Intermediate Transfer Belt]

An intermediate transfer belt was constituted in the same manner as the intermediate transfer belt in Example 1, except that the elastic layer has a width of 331 mm and a thickness of 250 μm.

[Cleaning Blade]

A cleaning blade was constituted in the same manner as the cleaning blade in Example 1, except that the longitudinal direction width is 331 mm which is the same width of the elastic layer of the intermediate transfer belt.

Comparative Example 2

[Intermediate Transfer Belt]

An intermediate transfer belt was constituted in the same manner as the intermediate transfer belt in Example 1, except that the elastic layer has a thickness of 250 μm.

[Cleaning Blade]

A cleaning blade was constituted in the same manner as the cleaning blade in Example 1, except that the longitudinal direction width is 327 mm which is shorter than the width of the elastic layer of the intermediate transfer belt.

Comparative Example 3

[Intermediate Transfer Belt]

An intermediate transfer belt was constituted in the same manner as the intermediate transfer belt in Example 1, except that a thickness of the elastic layer is 250 μm, and each projecting portion formed on a surface of the elastic layer has the minimum width and the maximum width of less than 2.0

μm, and the minimum projection height and the maximum projection height of less than 2.0 μm.

[Cleaning Blade]

A cleaning blade was constituted in the same manner as the cleaning blade in Example 1.

Comparative Example 4

[Intermediate Transfer Belt]

An intermediate transfer belt was constituted in the same manner as the intermediate transfer belt in Example 1, except that a thickness of the elastic layer is 250 μm, and each projecting portion formed on a surface of the elastic layer has the minimum width of 5.0 μm, the maximum width of 7.0 μm, the minimum projection height of 5.0 μm and the maximum projection height of 7.0 m.

[Cleaning Blade]

A cleaning blade was constituted in the same manner as the cleaning blade in Example 1, except that the longitudinal direction width is 341 mm.

<Evaluation Result>

Evaluation results are shown in Table 1

TABLE 1

| | Intermediate transfer belt | | | | | | | | Cleaning blade | | |
|---|---|---|---|---|---|---|---|---|---|---|---|
| | Rotating circumferential speed (mm/sec) | Width of base material (mm) | Elastic layer | | Projecting portion | | | | Longitudinal direction width (Side length of abutting side) (mm) | Evaluation | |
| | | | | | Width (μm) | | Projection height (μm) | | | Ride-up property of blade | Cleaning property |
| | | | Width (mm) | Thickness (μm) | Minimum value | Maximum value | Minimum value | Maximum value | | | |
| Example 1 | 220 | 357 | 337 | 150 | 3.0 | 4.5 | 3.0 | 4.5 | 340 | Excellent | Excellent |
| Example 2 | 220 | 357 | 337 | 250 | 3.0 | 4.5 | 3.0 | 4.5 | 341 | Excellent | Excellent |
| Example 3 | 220 | 357 | 337 | 400 | 3.0 | 4.5 | 3.0 | 4.5 | 342 | Excellent | Excellent |
| Example 4 | 220 | 357 | 337 | 75 | 2.0 | 4.0 | 2.0 | 4.0 | 340 | Excellent | Excellent |
| Example 5 | 220 | 357 | 337 | 420 | 4.0 | 6.0 | 4.0 | 6.0 | 340 | Good | Good |
| Comparative Example 1 | 220 | 357 | 337 | 250 | 3.0 | 4.5 | 3.0 | 4.5 | 331 | Fair | Fair |
| Comparative Example 2 | 220 | 357 | 331 | 250 | 3.0 | 4.5 | 3.0 | 4.5 | 327 | Poor | Poor |
| Comparative Example 3 | 220 | 357 | 337 | 250 | <2.0 | <2.0 | <2.0 | <2.0 | 340 | Poor | Excellent |
| Comparative Example 4 | 220 | 357 | 337 | 250 | 5.0 | 7.0 | 5.0 | 7.0 | 341 | Excellent | Poor |

As is apparent from Table 1, in Examples 1 to 5 wherein the longitudinal direction width of the cleaning blade is set to be larger than the width of the elastic layer of the intermediate transfer belt, and projecting portions formed on a surface of the elastic layer have the minimum projection height of 2.0 μm or more and the maximum projection height of 6.0 μm or less, and additionally have the minimum width of 2.0 μm or more and the maximum width of 6.0 μm or less, reversal phenomenon of the cleaning blade is prevented from occurring, and good cleaning property is obtained over a long period of time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An intermediate transfer body comprising:

an endless intermediate transfer belt rotatably disposed by being supported around a plurality of supporting rollers with tension, the endless intermediate transfer belt bearing and transporting an toner image on an outer peripheral surface thereof, the endless intermediate transfer belt including:

a base material, an elastic layer formed on a surface of the base material, and a plurality of projecting portions formed side by side in a width direction of the intermediate transfer belt, each projecting outwardly from a surface of the elastic layer, extending over an entire periphery of the elastic layer in parallel with a rotation direction of the intermediate transfer belt, the plurality of projecting portions each having a minimum projection height of 2.0 μm or more, a maximum projection height of 6.0 μm or less, a minimum top face width of 2.0 μm or more, and a maximum top face width of 6.0 μm or less; and a belt cleaning section which removes a residual toner remaining on the outer peripheral surface of the intermediate transfer belt after transferring the toner image to a recording medium, the belt cleaning section including:

a cleaning blade formed of a plate-like elastic member, having an abutting side which is a straight end side abutting on the outer peripheral surface of the intermediate transfer belt, and removing a residual toner by abutting on the outer peripheral surface of the intermediate transfer belt, the cleaning blade being provided so as to be parallel to the width direction of the intermediate transfer belt, a side length of the abutting side being longer than a width of the elastic layer in the width direction of the intermediate transfer belt, and a housing which supports end sides other than the abutting side of the cleaning blade and contains a residual toner removed by the cleaning blade, wherein the abutting side of the cleaning blade abuts such that the elastic layer of the intermediate transfer belt distorts in a ratio of 1.0 to 10% with respect to its thickness.

2. The intermediate transfer body of claim 1, wherein the cleaning blade is formed such that the side length of the abutting side is longer than a length obtained by adding the width of the elastic layer in the width direction of the intermediate transfer belt and a snaking width.

3. The intermediate transfer body of claim 1, wherein the intermediate transfer belt is formed such that a width of the base material in the width direction thereof is longer than the width of the elastic layer, and the cleaning blade is formed such that the side length of the abutting side is shorter than or equal to the width of the base material in the width direction of the intermediate transfer belt.

4. The intermediate transfer body of claim 1, wherein the cleaning blade is provided such that the abutting side abuts on the outer peripheral surface of the intermediate transfer belt under a linear pressure of 14.7 to 44.1 N/m.

5. An image forming apparatus comprising the intermediate transfer body of claim 1.

* * * * *